US010297187B2

(12) United States Patent
Bang

(10) Patent No.: US 10,297,187 B2
(45) Date of Patent: May 21, 2019

(54) GAMMA VOLTAGE GENERATOR, DISPLAY DEVICE HAVING THE SAME, AND METHOD FOR GENERATING GAMMA VOLTAGES

(71) Applicant: Samsung Display Co., LTD., Yongin-si, Gyeonggi-do (KR)

(72) Inventor: Sung-Hoon Bang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 394 days.

(21) Appl. No.: 15/073,473

(22) Filed: Mar. 17, 2016

(65) Prior Publication Data

US 2017/0076656 A1 Mar. 16, 2017

(30) Foreign Application Priority Data

Sep. 10, 2015 (KR) ..... 10-2015-0128121

(51) Int. Cl.
*G09G 3/36* (2006.01)
*G09G 3/20* (2006.01)

(52) U.S. Cl.
CPC ..... *G09G 3/2092* (2013.01); *G09G 3/2007* (2013.01); *G09G 3/3696* (2013.01); *G09G 2310/027* (2013.01); *G09G 2320/0233* (2013.01); *G09G 2320/0276* (2013.01); *G09G 2320/0673* (2013.01); *G09G 2330/028* (2013.01)

(58) Field of Classification Search
CPC .. G09G 3/2092; G09G 3/2007; G09G 3/3696; G09G 2310/027
USPC ..... 345/92
See application file for complete search history.

(56) References Cited

U.S. PATENT DOCUMENTS

2011/0175937 A1* 7/2011 Weng ..... G09G 3/3688 345/690
2013/0271507 A1* 10/2013 Kim ..... G09G 3/3291 345/690
2014/0184657 A1* 7/2014 Lee ..... G09G 5/10 345/690

FOREIGN PATENT DOCUMENTS

KR 10-2014-0058966 A 5/2014

* cited by examiner

*Primary Examiner* — Jonathan M Blancha
(74) *Attorney, Agent, or Firm* — Lewis Roca Rothgerber Christie LLP

(57) ABSTRACT

A gamma voltage generator includes a reference gamma selector configured to receive a first reference voltage and a second reference voltage greater than the first reference voltage, and to select top and bottom reference gamma voltages respectively corresponding to maximum and minimum gamma tab voltages that are between the first and second reference voltages, a gamma tab generator configured to select a plurality of gamma tab voltages between the maximum and minimum gamma tab voltages based on the top and bottom reference gamma voltages, a maximum gamma compensator configured to select a compensating gamma tab voltage that is greater than the maximum gamma tab voltage based on the top reference gamma voltage and a third reference voltage greater than the second reference voltage, and a gamma output configured to divide the gamma tab voltages and the compensating gamma tab voltage, and output gamma voltages corresponding to a gamma curve.

13 Claims, 10 Drawing Sheets

GAMMA VOLTAGE GENERATOR, DISPLAY DEVICE HAVING THE SAME, AND METHOD FOR GENERATING GAMMA VOLTAGES

CROSS REFERENCE TO RELATED APPLICATION

This application claims priority to, and the benefit of, Korean Patent Application No. 10-2015-0128121, filed on Sep. 10, 2015 in the Korean Intellectual Property Office (KIPO), the disclosure of which is hereby incorporated by reference herein in its entirety.

BACKGROUND

1. Field

Example embodiments of the inventive concept relate to display devices, gamma voltage generators, display devices having the gamma voltage generators, and methods for generating gamma voltages.

2. Description of Related Art

In general, a display device includes a display panel and a driver (e.g., a panel driver). The display panel includes a plurality of pixels. The driver may include a scan driver for providing a scan signal to the pixels, and a data driver providing a data signal to the pixels. The data driver may convert digital image data received from a controller into an analog data signal based on gamma voltages output form a gamma voltage generator.

The display device adjusts a plurality of gamma tab voltages for compensating the gamma voltages to generate a gamma curve to display an image. When the pixel, which may include an organic light emitting diode in the display device, is degraded, a voltage output that is greater than a maximum level of the gamma voltage is sometimes necessary to compensate the degradation to thereby correct the image.

To compensate the degradation, conventional display devices may adjust a minimum reference voltage and a maximum reference voltage provided to a gamma voltage generator to set a margin to the gamma tab voltage, or may perform a data remapping for reducing an entirety of a voltage range of the gamma voltages to output a gamma voltage that is greater than a previous maximum level of the gamma voltage. However, a resolution of the gamma voltage with respect to predetermined bits is decreased, so that a grayscale inversion, a mixture of grayscales in a middle grayscale, etc. may occur, and so that display quality may decrease.

SUMMARY

Example embodiments provide a gamma voltage generator configured to compensate a gamma tab voltage that is greater than a previous maximum gamma tab voltage to expand a range of gamma voltages.

Example embodiments provide a method for generating gamma voltages by selecting a compensating gamma tab voltage that is greater than a maximum gamma tab voltage to thereby expand a range of gamma voltages.

Example embodiments provide a display device including the gamma voltage generator.

According to example embodiments, a gamma voltage generator includes a reference gamma selector configured to receive a first reference voltage, receive a second reference voltage that is greater than the first reference voltage, select a top reference gamma voltage corresponding to a maximum gamma tab voltage that is between the first reference voltage and the second reference voltage, select a bottom reference gamma voltage corresponding to a minimum gamma tab voltage that is between the first reference voltage and the second reference voltage, a gamma tab generator configured to select a plurality of gamma tab voltages that are between the maximum gamma tab voltage and the minimum gamma tab voltage based on the top reference gamma voltage and based on the bottom reference gamma voltage, a maximum gamma compensator configured to select a compensating gamma tab voltage that is greater than the maximum gamma tab voltage based on the top reference gamma voltage and based on a third reference voltage that is greater than the second reference voltage, and a gamma output configured to divide the gamma tab voltages and the compensating gamma tab voltage, and output gamma voltages corresponding to a gamma curve.

The maximum gamma compensator may be further configured to select the compensating gamma tab voltage such that a range of the gamma voltages is expanded.

The range of the gamma voltages may be from the minimum gamma tab voltage to the compensating gamma tab voltage.

The maximum gamma compensator may include a compensating resistor string configured to divide voltages between the third reference voltage and the top reference gamma voltage, and a compensating gamma selector configured to select one of the voltages divided by the compensating resistor string as the compensating gamma tab voltage based on a compensating gamma select signal.

The gamma curve may be generated based on a range from the minimum gamma tab voltage to the compensating gamma tab voltage.

The gamma voltage generator may further include a maximum gamma selector configured to select the maximum gamma tab voltage or the compensating gamma tab voltage as an output gamma tab voltage based on a compensating enable signal, and provide the output gamma tab voltage to the gamma output.

The maximum gamma selector may be configured to select the maximum gamma tab voltage as the output gamma tab voltage when a target grayscale voltage, which corresponds to compensated image data for compensating degradation, is less than or equal to the maximum gamma tab voltage.

The maximum gamma selector may be configured to select the compensating gamma tab voltage as the output gamma tab voltage when a target grayscale voltage, which corresponds to compensated image data for compensating degradation, is greater than the maximum gamma tab voltage.

The reference gamma selector may include a reference resistor string configured to divide voltages between the first reference voltage and the second reference voltage, a first reference selector configured to select one of the voltages divided by the reference resistor string as the bottom reference gamma voltage based on a bottom select signal, and a second reference selector configured to select one of the voltages divided by the reference resistor string as the top reference gamma voltage based on a top select signal.

The gamma tab generator may include a plurality of resistor strings dependently connected to divide voltages between the top reference gamma voltage and the bottom reference gamma voltage, and a plurality of gamma tab selectors each configured to select one of the voltages divided by the plurality of resistor strings as one of the gamma tab voltages based on a plurality of gamma tab select signals.

The gamma output may include a resistor string to divide voltages between the minimum gamma tab voltage and the compensating gamma tab voltage.

According to example embodiments, a method for generating gamma voltages includes selecting a top reference gamma voltage corresponding to a maximum gamma tab voltage, and selecting a bottom reference gamma voltage corresponding to a minimum gamma tab voltage, based on a first reference voltage, and based on a second reference voltage that is greater than the first reference voltage, selecting a plurality of gamma tab voltages, which are between the maximum gamma tab voltage and the minimum gamma tab voltage, based on the top reference gamma voltage, and based on the bottom reference gamma voltage, comparing a target grayscale voltage, which corresponds to compensated image data for compensating degradation, with the maximum gamma tab voltage, selecting the maximum gamma tab voltage when the target grayscale voltage is less than or equal to the maximum gamma tab voltage, and selecting a compensating gamma tab voltage that is greater than the maximum gamma tab voltage when the target grayscale voltage is greater than the maximum gamma tab voltage.

The method may further include outputting a plurality of gamma voltages corresponding to a gamma curve by dividing voltages between the minimum gamma tab voltage and the maximum gamma tab voltage when the maximum gamma tab voltage is selected.

The method may further include outputting a plurality of gamma voltages corresponding to a gamma curve by dividing voltages between the minimum gamma tab voltage and the compensating gamma tab voltage when the compensating gamma tab voltage is selected.

The method may further include expanding a range of the gamma voltages when the compensating gamma tab voltage is selected.

The compensating gamma tab voltage may be between an externally supplied third reference voltage and the top reference gamma voltage.

The third reference voltage may be greater than the second reference voltage and the top reference gamma voltage.

According to example embodiments, a display device includes a display panel including a plurality of pixels, a scan driver configured to provide a scan signal to the pixels, a gamma voltage generator configured to output a plurality of gamma voltages corresponding to compensated image data for compensating degradation, a data driver configured to generate a data signal based on the gamma voltages, and configured to provide the data signal to the pixels, and a controller configured to generate the compensated image data, and configured to control the scan driver, the gamma voltage generator, and the data driver, wherein the gamma voltage generator includes a reference gamma selector configured to receive a first reference voltage, receive a second reference voltage that is greater than the first reference voltage, select a top reference gamma voltage, which corresponds to a maximum gamma tab voltage, between the first reference voltage and the second reference voltage, and select a bottom reference gamma voltage, which corresponds to a minimum gamma tab voltage, between the first reference voltage and the second reference voltage, a gamma tab generator configured to select a plurality of gamma tab voltages between the maximum gamma tab voltage and the minimum gamma tab voltage based on the top reference gamma voltage, and based on the bottom reference gamma voltage, a maximum gamma compensator configured to select a compensating gamma tab voltage that is greater than the maximum gamma tab voltage based on the top reference gamma voltage, and based on a third reference voltage that is greater than the second reference voltage, and a gamma output configured to divide the gamma tab voltages and the compensating gamma tab voltage to output the gamma voltages corresponding to a gamma curve.

The maximum gamma compensator may be further configured to select the compensating gamma tab voltage to expand a range of the gamma voltages.

The range of the gamma voltages may be from the minimum gamma tab voltage to the compensating gamma tab voltage.

According to the above, the gamma voltage generator and the display device having the same according to example embodiments may include the maximum gamma compensator for outputting the compensating gamma tab voltage that is greater than the maximum gamma tab voltage based on a compensation of degradation, such that the voltage range of the gamma voltages output from the gamma voltage generator may be expanded. Accordingly, the gamma curve of the display may be generated without a gamma resolution loss, even if the compensation of the degradation is performed. Furthermore, a maximum luminance level capable of being displayed may be increased as the voltage range of the gamma voltages is expanded.

In addition, the method for generating the gamma voltages according to example embodiments may additionally provide the compensating gamma tab voltage that is greater than the maximum gamma tab voltage according to a degree of degradation (or compensation of the degradation) such that the range of the gamma voltages may be expanded.

BRIEF DESCRIPTION OF THE DRAWINGS

Example embodiments can be understood in more detail from the following description when taken in conjunction with the accompanying drawings, in which.

DETAILED DESCRIPTION

Figure 1:
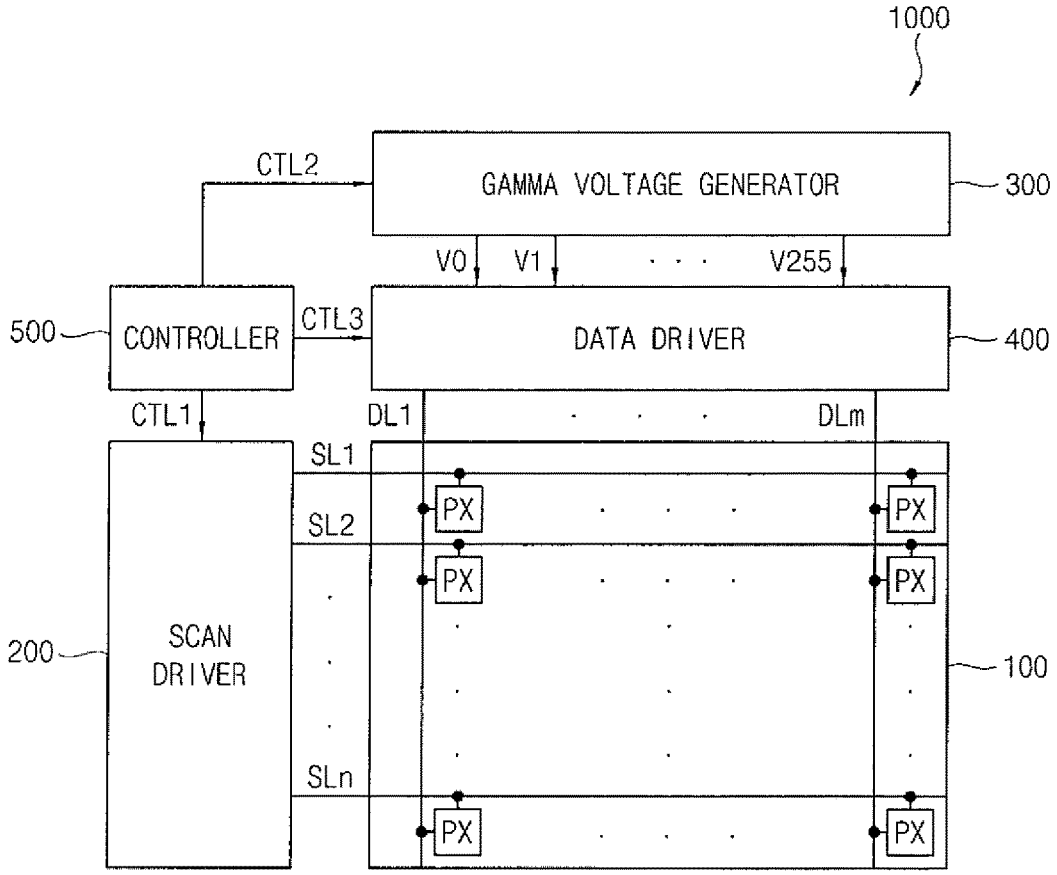
FIG. 1 is a block diagram of a display device according to example embodiments.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram of a display device according to example embodiments.

Referring to FIG. 1, the display device 1000 may include a display panel 100, a scan driver 200, a gamma voltage generator 300, a data driver 400, and a controller 500.

The display panel 100 may include a plurality of pixels PX. The display panel 100 may be connected to the scan driver 200 via a plurality of scan lines SL1 to SLn (i.e., n scan lines, n being a positive integer). The display panel 100 may be connected to the data driver 400 via a plurality of data lines DL1 to DLm (i.e., m data lines, m being a positive integer). The display panel 100 may include n*m pixels PX, as the pixels PX are arranged at locations corresponding to crossing regions of the scan lines SL1 to SLn and the data lines DL1 to DLm.

The scan driver 200 may provide a scan signal to the pixels PX via the scan lines SL1 to SLn based on a first control signal CTL1.

The gamma voltage generator 300 may output a plurality of gamma voltages V0 to V255 corresponding to compensated image data, in which degradation of a pixel is compensated. The gamma voltage generator 300 may output the gamma voltages V0 to V255 based on a second control signal CTL2 that includes degradation information of a degraded pixel. The gamma voltage generator 300 may generate gamma voltages V0 to V255 corresponding to a gamma curve that is based on a plurality of gamma tab voltages, and that is based on a compensating gamma tab voltage. In some embodiments, the gamma voltage generator 300 may select the compensating gamma tab voltage to improve grayscale inversion by the compensation of the degradation, such that the entire voltage range of the gamma voltages V0 to V255 may be expanded.

In some embodiments, the gamma voltage generator 300 may include a reference gamma selector configured to receive a first reference voltage, configured to receive a second reference voltage that is greater than the first reference voltage, configured to select a top reference gamma voltage corresponding to a maximum gamma tab voltage, and configured to select a bottom reference gamma voltage corresponding to a minimum gamma tab voltage within a range between the first and second reference voltages. The gamma voltage generator 300 may also include a gamma tab generator that is configured to select the plurality of gamma tab voltages within a range between the maximum gamma tab voltage and the minimum gamma tab voltage based on the top reference gamma voltage and based on the bottom reference gamma voltage. The gamma voltage generator 300 may also include a maximum gamma compensator that is configured to additionally select the compensating gamma tab voltage that is greater than the maximum gamma tab voltage based on the top reference gamma voltage and based on a third reference voltage, which is greater than the second reference voltage, and may also include a gamma output that is configured to divide the gamma tab voltages and the compensating gamma tab voltage to output the plurality of gamma voltages V0 to V255 corresponding to the gamma curve. The gamma voltage generator will be described in detail with reference to FIGS. 3 and 4.

The data driver 400 may generate a data signal based on the gamma voltages V0 to V255. The data driver 400 may provide the data signal to the pixels PX via the data lines DL1 to DLm based on a third control signal CTL3.

The controller 500 may generate the first, second, and third control signals CTL1, CTL2, and CTL3 to respectively control the scan driver 200, the gamma voltage generator 300, and the data driver 400. The controller 500 may detect the degradation of the pixel PX, and may generate the compensated image data and compensating data including the degradation information corresponding to the image data. In some embodiments, the controller 500 may provide the compensating data to the gamma voltage generator 300 to compensate the degradation. The compensated image data may be provided to the data driver 400 and/or to the gamma voltage generator 300. In some embodiments, the controller 500 may control a plurality of select signals based on the compensated image data. The select signals may be provided to the gamma voltage generator 300.

Additionally, the display device 1000 may further include a power supply for applying powers to the display panel 100, the scan driver 200, the gamma voltage generator 300, and the data driver 400. The display device 1000 may further include a sensing unit to detect the degradation of the pixels PX.

Figure 2:
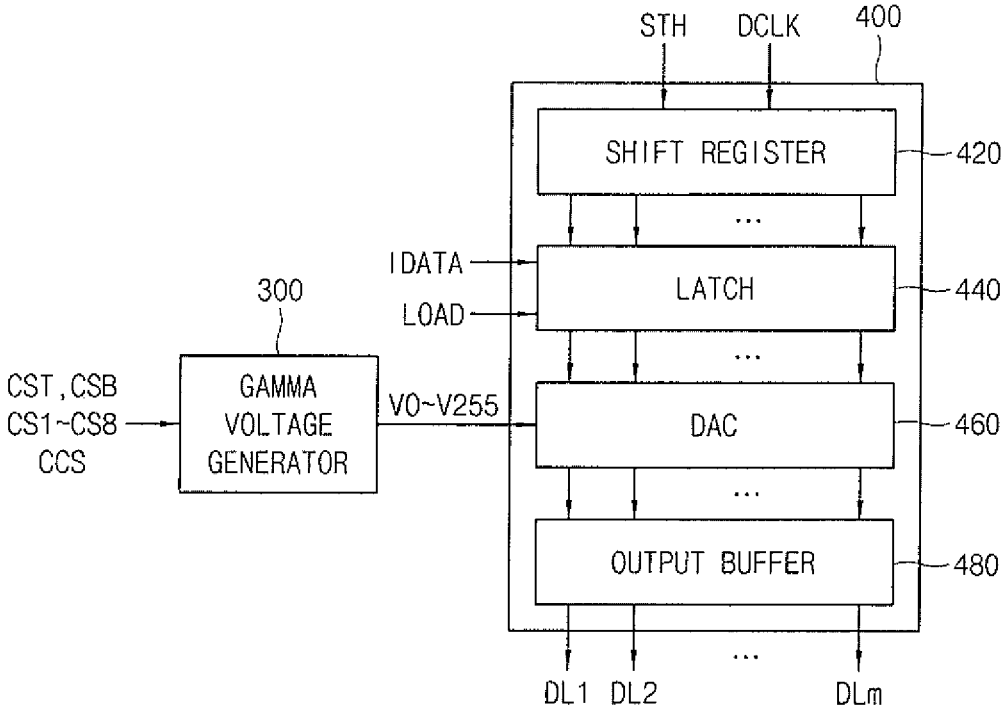
FIG. 2 is a block diagram illustrating an example of a data driver included in the display device of FIG. 1.

FIG. 2 is a block diagram illustrating an example of a data driver included in the display device of FIG. 1.

Referring to FIG. 2, the data driver 400 may include a shift register 420, a latch 440, a digital-analog converter (DAC) 460, and an output buffer 480.

The shift register 420 may receive a horizontal start signal STH and a data clock signal DCLK. The shift register 420 may shift the horizontal start signal STH for synchronizing the data clock signal DCLK to generate a sampling signal.

The latch circuit 440 may latch input data IDATA in response to the sampling signal. The latch circuit 440 may output the latched input data IDATA in response to a load signal LOAD.

The digital-analog converter (DAC) 460 may convert the latched input data IDATA into the data signal based on a plurality of gamma voltages V0 to V255. A gamma voltage generator 300 may receive a plurality of select signals CST, CSB, CS1 to CS8, and CCS based on compensated image data from a controller and output the gamma voltages V0 to V255 based on the select signals CST, CSB, CS1 to CS8, and CCS. The digital-analog converter 460 may convert digital input data into an analog data signal based on the received gamma voltages V0 to V255.

The output buffer 480 may output the data signal received from the digital-analog (DAC) converter 460 to the data lines DL1 to DLm.

Figure 3:
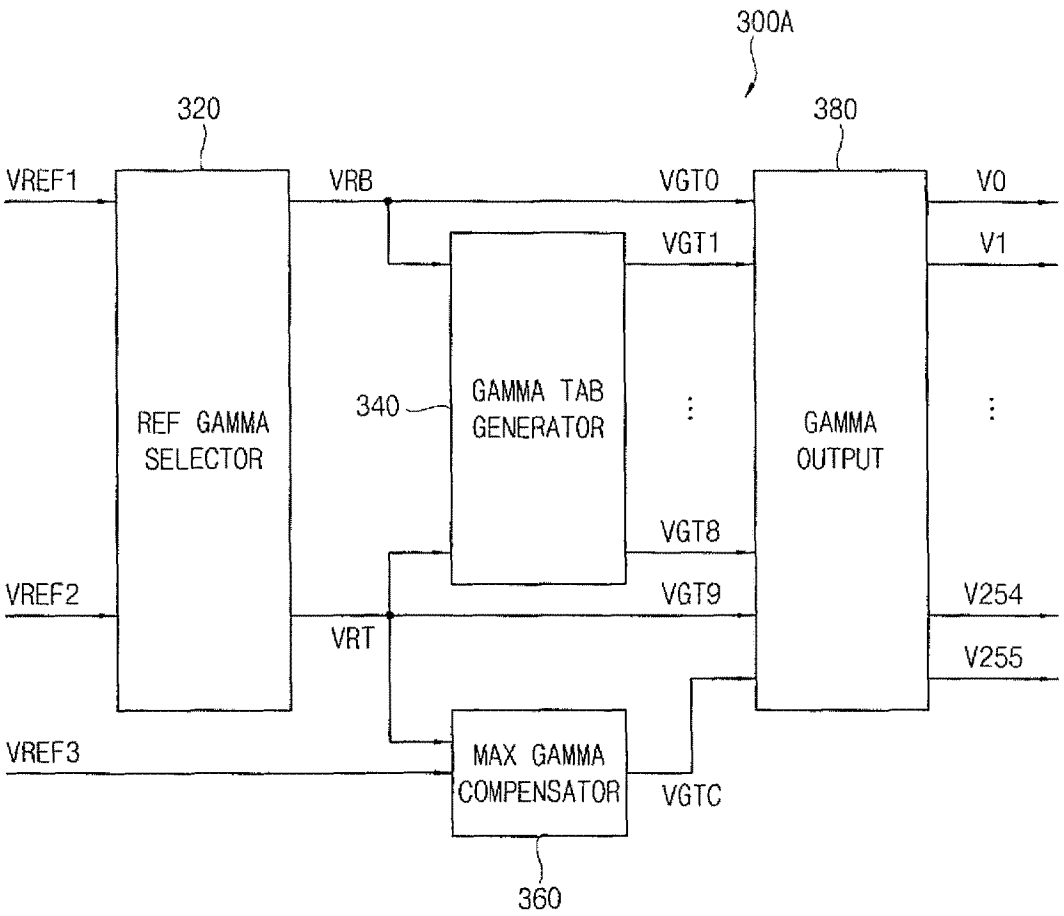
FIG. 3 is a block diagram of a gamma voltage generator according to example embodiments.
Figure 4:
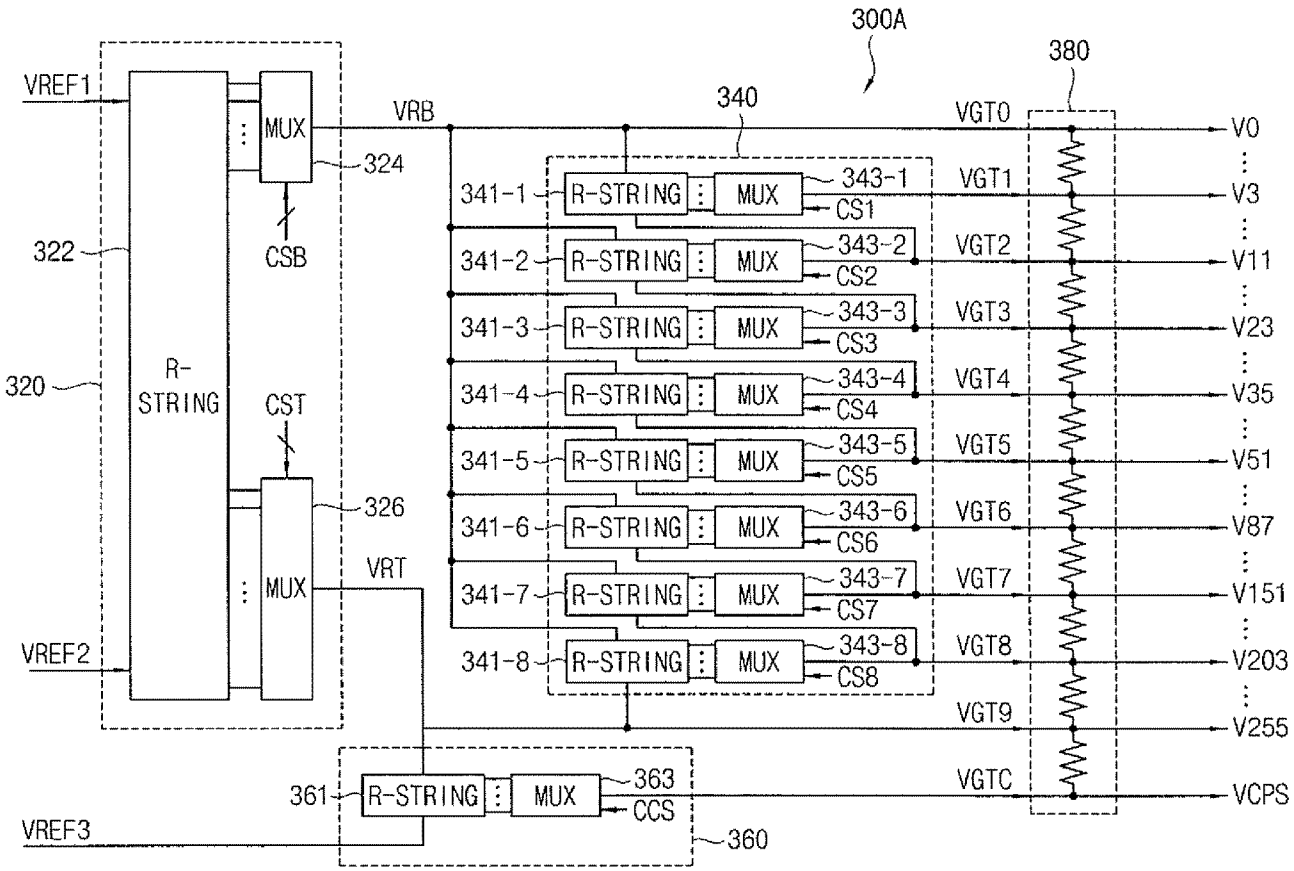
FIG. 4 is a diagram illustrating an example of the gamma voltage generator of FIG. 3.

FIG. 3 is a block diagram of a gamma voltage generator according to example embodiments, and FIG. 4 is a diagram illustrating an example of the gamma voltage generator of FIG. 3.

Referring to FIGS. 3 and 4, the gamma voltage generator 300A may include a reference gamma selector 320, a gamma tab generator 340, a maximum gamma compensator 360, and a gamma output 380.

The reference gamma selector 320 may receive a first reference voltage VREF1, and may receive a second reference voltage VREF2 that is greater than the first reference voltage VREF1. The reference gamma selector 320 may select a top reference gamma voltage VRT corresponding to a maximum gamma tab voltage VGT9, and may select a bottom reference gamma voltage VRB corresponding to a minimum gamma tab voltage VGT0, the top reference gamma voltage VRT and the bottom reference gamma voltage VRB being within a range between the first and second reference voltages VREF1 and VREF2. Here, the top reference gamma voltage VRT and the bottom reference gamma voltage VRB may determine a range of a plurality of gamma tab voltages within a range between the maximum gamma tab voltage VGT9 and the minimum gamma tab voltage VGT0. In some embodiments, the reference gamma selector 320 may adjust the top reference gamma voltage VRT and/or the bottom reference gamma voltage VRB based on image data or compensated image data. In some embodiments, the reference gamma selector 320 may select an increased top reference gamma voltage VRT as the compensated image data that has increased grayscale.

In some embodiments, as illustrated in FIG. 4, the reference gamma selector 320 may include a reference resistor string (R-STRING) 322, a first reference selector (MUX) 324, and a second reference selector (MUX) 326.

The reference resistor string 322 may divide voltages between the first reference voltage VREF1 and the second reference voltage VREF2. The reference resistor string 322 may include a plurality of resistors connected in series with each other. The first reference voltage VREF1 may be applied to one end of the reference resistor string 322, and the second reference voltage VREF2 may be applied to the other end of the reference resistor string 322. A plurality of voltages may be divided and outputted at each contact point of the resistors included in the reference resistor string 322.

The first reference selector 324 may select one of the voltages divided by the reference resistor string 322 as the bottom reference gamma voltage VRB based on a bottom select signal CSB. In some embodiments, the first reference selector 324 may be a multiplexer for selecting one of 8 input voltages received from the reference resistor string 322. In this case, the bottom select signal CSB may correspond to a 3-bit register value. In some embodiments, the bottom reference gamma voltage VRB may correspond to the minimum gamma tab voltage VGT0. For example, the minimum gamma tab voltage VGT0 may correspond to the gamma voltage V0 of 0 grayscale (e.g., a black voltage).

The second reference selector 326 may select one of the voltages divided by the reference resistor string 322 as the top reference gamma voltage VRT based on a top select signal CST. In some embodiments, the second reference selector 326 may be a multiplexer for selecting one of 512 input voltages. In this case, the top select signal CST may correspond to a 9-bit register value. In some embodiments, the top reference gamma voltage VRT may correspond to the maximum gamma tab voltage VGT9. For example, the maximum gamma tab voltage VGT9 may correspond to the gamma voltage V255 (e.g., a maximum gamma voltage) of 255 grayscale in which the pixel is not degraded.

The gamma tab generator 340 may select a plurality of gamma tab voltages within a range between the maximum gamma tab voltage VGT9 and the minimum gamma tab voltage VGT0 based on the top reference gamma voltage VRT and the bottom reference gamma voltage VRB.

In some embodiments, the gamma tab generator 340 may include a plurality of resistor strings 341-1 to 341-8 that are dependently connected, and may include a plurality of gamma tab selectors 343-1 to 343-8 respectively connected to the resistor strings 341-1 to 341-8. The resistor strings 341-1 to 341-8 may be dependently connected to divide voltages between the top reference gamma voltage VRT and the bottom reference gamma voltage VRB. The gamma tab selectors 343-1 to 343-8 may select one of voltages divided by the resistor strings 341-1 to 341-8 as one of the gamma tab voltages VGT1 to VGT8 based on a plurality of gamma tab select signals CS1 to CS8, respectively. For example, each of the gamma tab selectors 343-1 to 343-8 may be a multiplexer for selecting one of 256 input voltages. In this case, the gamma tab select signals CS1 to CS8 respectively received by the gamma tab selectors 343-1 to 343-8 may correspond to 8-bit register values.

For example, the gamma tab generator 340 may include cascade stages. The gamma tab generator 340 may include first to (N)th stages that are dependently connected, where N is an integer greater than 1. A (K)th stage of first to (N)th stages may include a (K)th resistor string 341-K and a (K)th gamma tab selector 343-K, where K is an integer greater than 1 and less than or equal to N. The (K)th resistor string may divide voltages between the bottom reference gamma voltage VRB, and a (K+1)th gamma tab voltage output from a (K+1)th stage. The (K)th gamma tab selector may select one of the voltages divided by the (K)th resistor as the (K)th gamma tab voltage string based on a (K)th gamma tab select signal. For example, the first stage may include the first resistor string 341-1 for dividing voltages between the bottom reference gamma voltage VRB and a second gamma tab voltage VGT2, and may include the first gamma tab selector 343-1 for selecting one of the voltages divided by the first resistor string 341-1 as a first gamma tab voltage VGT1 based on the first gamma tab select signal CS1. Here, the first gamma tab voltage VGT1 may correspond to 3 grayscale gamma voltage V3. The eighth stage may include the eighth resistor string 341-8 for dividing voltages between the bottom reference gamma voltage VRB and the top reference gamma voltage VRT, and may include the eighth gamma tab selector 343-8 for selecting one of the voltages divided by the eighth resistor string 341-8 as an eighth gamma tab voltage VGT8 based on the eighth gamma tab select signal CS8. Here, the eighth gamma tab voltage VGT8 may correspond to a 203 grayscale gamma voltage V203, for example.

The maximum gamma compensator 360 may output a compensating gamma tab voltage VGTC that is greater than the maximum gamma tab voltage VGT9 based on a third reference voltage VREF3 that is greater than the second reference voltage VREF2. The maximum gamma compensator 360 may select the compensating gamma tab voltage VGTC such that whole range of the gamma voltages may be expanded. For example, the voltage range of the gamma voltages corresponding to 0 to 255 grayscales may respectively correspond to the minimum gamma tab voltage VGT0 to the compensating gamma tab voltage VGTC. Thus, a gamma curve generated by the gamma output 380 may be generated based on the minimum gamma tab voltage VGT0 to the compensating gamma tab voltage VGTC. In some embodiments, the maximum gamma compensator 360 may include a compensating resistor string 361 and a compensating gamma selector 363.

The compensating resistor string 361 may divide voltages between the third reference voltage VREF3 and the top reference gamma voltage VRT. The compensating resistor string 361 may be a plurality of resistors connected in series with each other. The third reference voltage VREF3 may be applied to one end of the compensating resistor string 361, and the top reference gamma voltage VRT may be applied to the other end of the compensating resistor string 361. A plurality of voltages may be divided and outputted at each contact point of the resistors included in the compensating resistor string 361.

The compensating gamma selector 363 may select one of voltages divided by the compensating resistor string 361 as the compensating gamma tab voltage VGTC based on a compensating gamma select signal CCS. In some embodiments, the compensating gamma selector 363 may be a multiplexer for selecting one of 256 input voltages. In this case, the compensating gamma select signal CCS may correspond to an 8-bit register value. The compensating gamma tab voltage VGTC may be greater than the maximum gamma tab voltage VGT9, due to the third reference voltage VREF3 being greater than the second reference voltage VREF2.

The maximum gamma compensator 360 might not be dependently connected to the gamma tab generator 340. Thus, although the pixels PX are not degraded, the gamma curve by the gamma tab voltage VGT0 to VGT9 excepting for the compensating gamma tab voltage VGTC. Thus, the expanded gamma voltages may be output based on the 11 gamma tab voltages (i.e., VGT0 to VGT9, and VGTC).

In some cases, as the compensation of the degradation is performed, a target grayscale voltage representing a certain grayscale image may be greater than the 255 grayscale gamma voltage V255 representing a predetermined 255 grayscale image. In this, the compensating gamma tab voltage VGTC may be selected as the 255 grayscale gamma voltage V255, such that the voltage range of the gamma voltages output from the gamma voltage generator 300A may be expanded. Here, the target grayscale voltage may correspond to a voltage range between the 255 grayscale gamma voltage V255 and the compensating gamma tab voltage VGTC. Thus, the gamma curve of the display may be generated without a gamma resolution loss, even if the compensation of the degradation is performed.

The gamma output 380 may divide the gamma tab voltages VGT0 to VGT9 to output the plurality of gamma voltages V0 to V255 corresponding to the gamma curve. In some embodiments, the gamma output 380 may include a resistor string to divide voltages within a range between the minimum gamma tab voltage VGT0 and the compensating gamma tab voltage VGTC, to thereby generate gamma voltages V0 to VCPS. Here, a compensating gamma maximum voltage VCPS, which is greater than the 255 grayscale gamma voltage V255, may be output due to the compensating gamma tab voltage VGTC. Thus, when the target grayscale voltage is greater than the 255 grayscale gamma voltage V255 to compensate the degradation, the voltage range of the gamma voltages for generating the gamma curve may be expanded by the compensating gamma maximum voltage VCPS.

Figure 5:
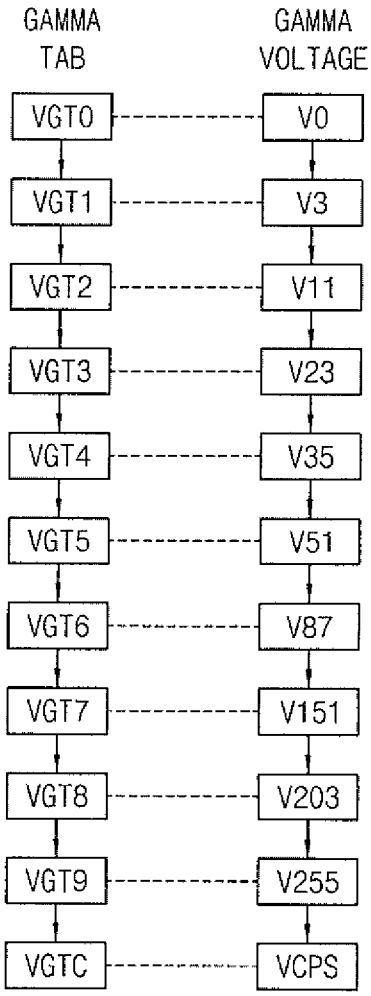
FIG. 5 is a diagram illustrating an example of which the gamma voltage generator of FIG. 3 outputs gamma voltages.
Figure 6:
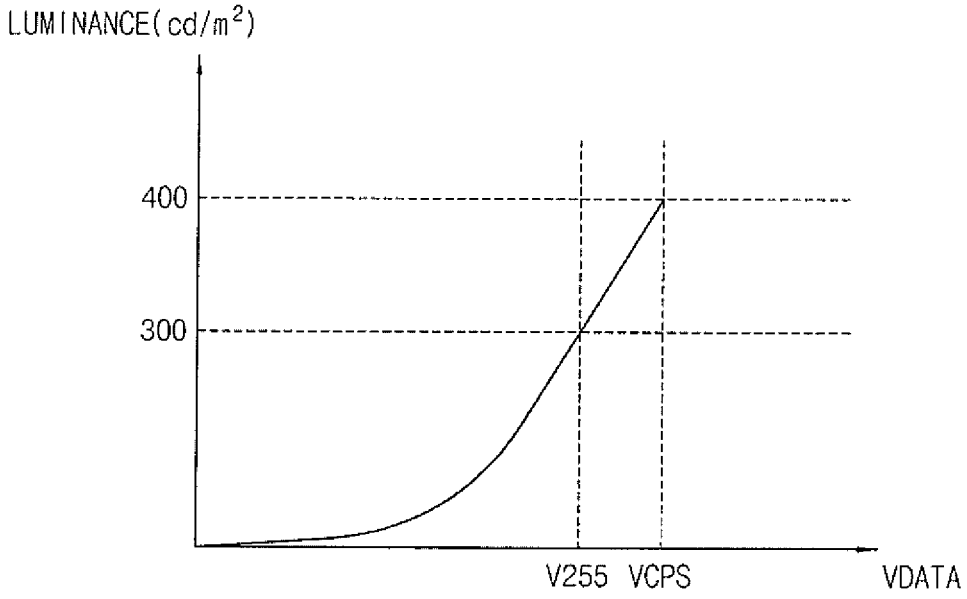
FIG. 6 is a graph illustrating an example of the gamma voltages of FIG. 5.

FIG. 5 is a diagram illustrating an example of which the gamma voltage generator of FIG. 3 outputs gamma voltages, and FIG. 6 is a graph illustrating an example of the gamma voltages of FIG. 5.

Referring to FIGS. 4 to 6, the gamma voltage generator 300A may output gamma voltages respectively corresponding to a specific grayscale.

As illustrated in FIG. 5, the gamma voltage generator 300A may output a plurality of gamma tab voltages VGT0 to VGT9, each corresponding to a respective grayscale, and may output a plurality of gamma voltages based on the gamma tab voltages VGT0 to VGT9. For example, a minimum gamma tab voltage VGT0 may correspond to a 0 grayscale gamma voltage representing a 0 grayscale, and a maximum gamma tab voltage VGT9 may correspond to a 255 grayscale gamma voltage representing a 255 grayscale. Similarly, the first gamma tab voltage VGT1 may correspond to a 3 grayscale gamma voltage representing a 3 grayscale, and the eighth gamma tab voltage VGT8 may correspond to a 203 grayscale gamma voltage representing a 203 grayscale.

In some embodiments, the gamma voltage generator 300A may further generate a compensating gamma tab voltage VGTC that is greater than the maximum gamma tab voltage VGT9, and may generate a compensating gamma maximum voltage VCPS that is greater than the 255 grayscale gamma voltage V255 based on the compensating gamma tab voltage VGTC. Thus, a plurality of gamma voltages within a range between the 255 grayscale gamma voltage V255 and the compensating gamma maximum voltage VCPS may be further output.

As illustrated in FIG. 6, an additional curve based on the compensating gamma maximum voltage VCPS may be added to the gamma curve corresponding to grayscales 0 to 255 without degradation. Thus, as described above, when the degradation occurs, the range of the gamma voltages output from the gamma voltage generator 300A may be expanded. Further, as the range of the gamma voltages is expanded, a maximum luminance level capable of being displayed may be increased. For example, as illustrated in FIG. 6, the compensating gamma maximum voltage VCPS may be added to the gamma voltages such that the maximum luminance level may be increased to 400 cd/$m^2$.

Figure 7:
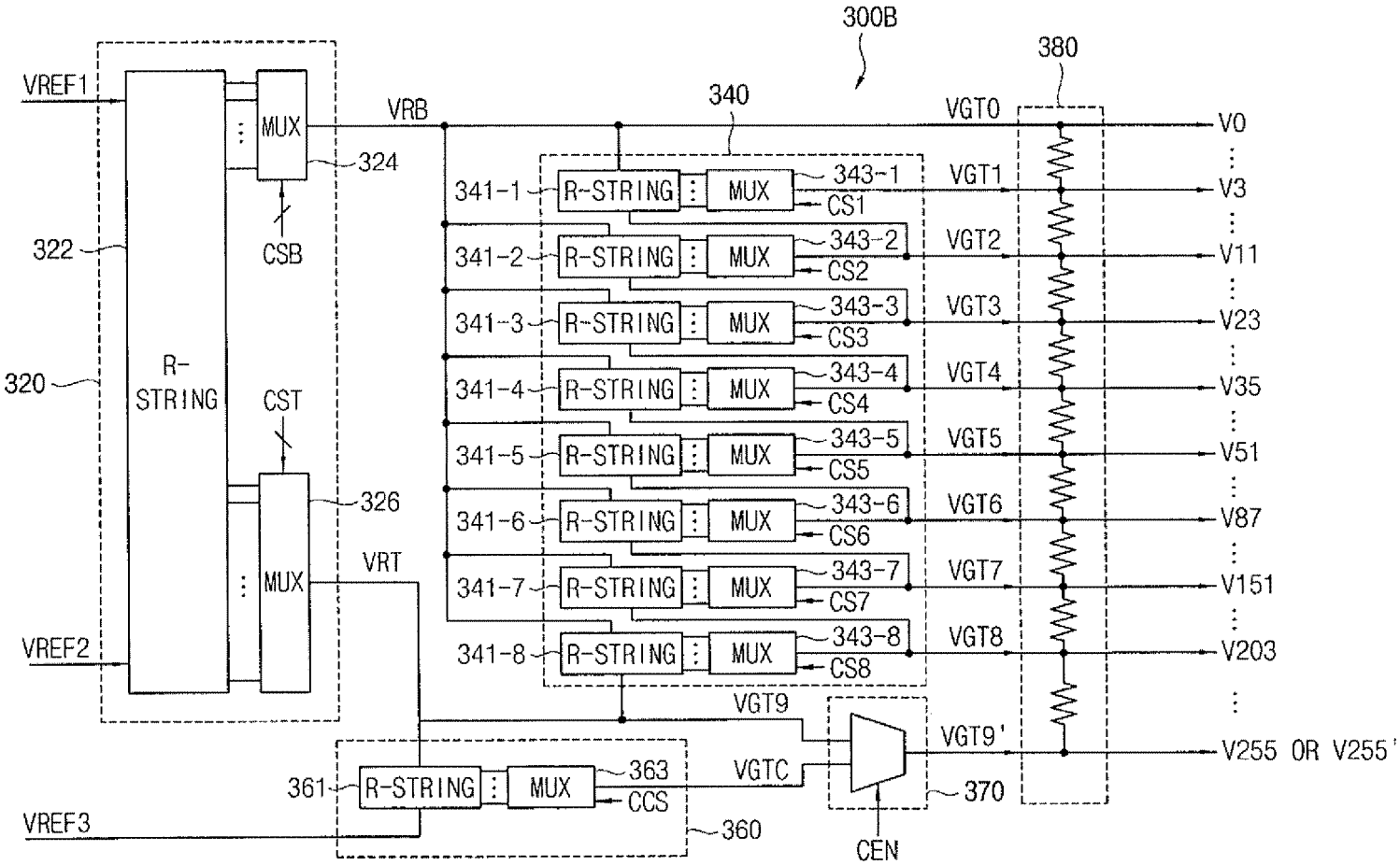
FIG. 7 is a diagram illustrating another example of the gamma voltage generator of FIG. 3.

FIG. 7 is a diagram illustrating another example of the gamma voltage generator of FIG. 3.

In FIG. 7, like reference numerals are used to designate similar elements of the gamma voltage generator in FIG. 3, and repeated detailed description of these elements may be omitted. The gamma voltage generator of FIG. 7 may be substantially the same as, or similar to, the gamma voltage generator of FIG. 3, with the exception of a maximum gamma selector 370.

Referring to FIGS. 3 and 7, the gamma voltage generator 300B may include a reference gamma selector 320, a gamma tab generator 340, a maximum gamma compensator 360, and a gamma output 380. The gamma voltage generator 300B may further include a maximum gamma selector 370.

The reference gamma selector 320 may receive a first reference voltage VREF1, and may receive a second reference voltage VREF2 that is greater than the first reference voltage VREF1. The reference gamma selector 320 may select a top reference gamma voltage VRT corresponding to a maximum gamma tab voltage VGT9, and may select a bottom reference gamma voltage VRB corresponding to a minimum gamma tab voltage VGT0, within a range between the first and second reference voltages VREF1 and VREF2. The gamma reference selector 320 may include a reference resistor string 322, a first reference selector 324, and a second reference selector 326.

The gamma tab generator 340 may select a plurality of gamma tab voltages (i.e., VGT1 to VGT8) within a range between the maximum gamma tab voltage VGT9 and the minimum gamma tab voltage VGT0 based on the top reference gamma voltage VRT and the bottom reference gamma voltage VRB.

The maximum gamma compensator 360 may output a compensating gamma tab voltage VGTC that is greater than the maximum gamma tab voltage VGT9 based on a third reference voltage VREF3 that is greater than the second reference voltage VREF2. The maximum gamma compensator 360 may select the compensating gamma tab voltage VGTC such that the entire range of the gamma voltages may be expanded. In some embodiments, the maximum gamma compensator 360 may include a compensating resistor string 361 and a compensating gamma selector 363.

The maximum gamma selector 370 may select either the maximum gamma tab voltage VGT9 and the compensating gamma tab voltage VGTC as an output gamma tab voltage VGT9' based on a compensating enable signal CEN to thereby provide the output gamma tab voltage VGT9' to the gamma output 380. In some embodiments, the maximum gamma tab voltage VGT9 may be substantially the same as the top reference gamma voltage VRT. The compensating enable signal CEN may select the maximum gamma tab voltage VGT9 or the compensating gamma tab voltage VGTC according to a level of a target grayscale voltage corresponding to compensated image data in which degradation is compensated. In some embodiments, the maximum gamma selector 370 may select the maximum gamma tab voltage VGT9 as the output gamma tab voltage VGT9' when the target grayscale voltage corresponding to compensated image data is less than or equal to the maximum gamma tab voltage VGT9. In some embodiments, the maximum gamma selector 370 may select the compensating gamma tab voltage VGTC as the output gamma tab voltage VGT9' when the target grayscale voltage corresponding to compensated image data is greater than the maximum gamma tab voltage VGT9. Thus, the full range of the gamma voltages V0 to V255' may be expanded when the target grayscale voltage is greater than the maximum gamma tab voltage VGT9. Here, the expanded gamma voltages may be output based on the 10 gamma tab voltages VGT0 to VGT9'.

The gamma output may divide the gamma tab voltages VGT0 to VGT9' to output the plurality of gamma voltages V0 to V255' corresponding to a gamma curve. In some embodiments, the gamma output 380 may include a resistor string to divide voltages within a range between the gamma tab voltages VGT0 to VGT9'. Here, a compensating gamma maximum voltage V255' that is greater than the top reference gamma voltage VRT (and that is greater than the maximum gamma tab voltage VGT9) may be output due to the compensating gamma tab voltage VGTC. Thus, when the target grayscale voltage is greater than the maximum gamma tab voltage VGT9, the range of the gamma voltages for generating the gamma curve may be expanded by the compensating gamma maximum voltage V255'. Therefore, the gamma curve of the display may be generated without a gamma resolution loss, even if the compensation of the degradation is performed.

Figure 8:
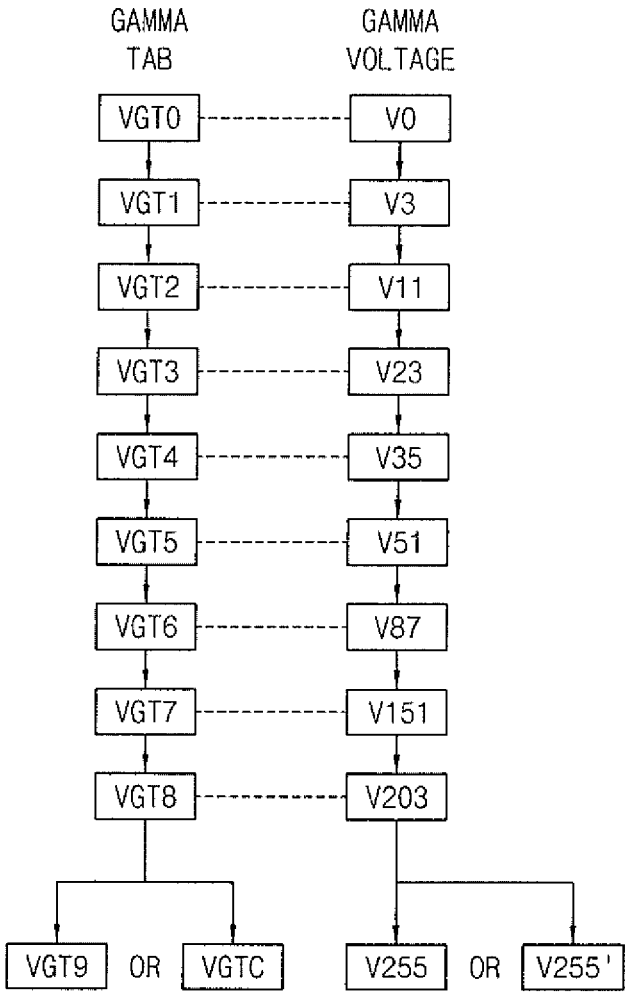
FIG. 8 is a diagram illustrating an example of which the gamma voltage generator of FIG. 7 outputs gamma voltages.
Figure 9:
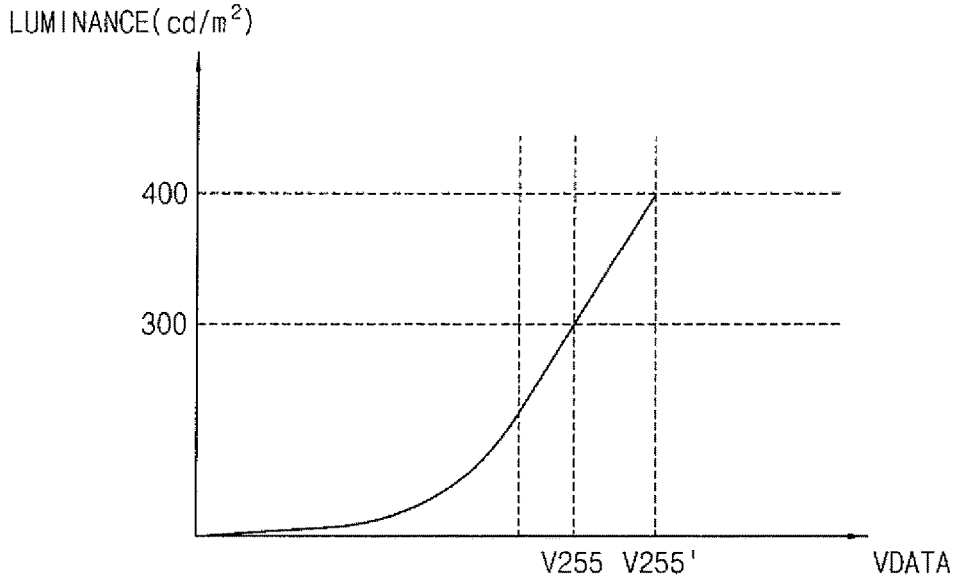
FIG. 9 is a graph illustrating an example of the gamma voltages of FIG. 8.

FIG. 8 is a diagram illustrating an example of which the gamma voltage generator of FIG. 7 outputs gamma voltages, and FIG. 9 is a graph illustrating an example of the gamma voltages of FIG. 8.

Referring to FIGS. 7 to 9, the gamma voltage generator 300B may output gamma voltages each corresponding to a specific grayscale.

As illustrated in FIG. 8, the gamma voltage generator 300B may output a plurality of gamma tab voltages VGT0 to VGT9 that respectively correspond to a specific grayscale, and may output a plurality of gamma voltages based on the gamma tab voltages VGT0 to VGT9. For example, a minimum gamma tab voltage VGT0 may correspond to a 0 grayscale gamma voltage representing a 0 grayscale, and a maximum gamma tab voltage VGT9 may correspond to a 255 grayscale gamma voltage representing a 255 grayscale. Similarly, the first gamma tab voltage VGT1 may correspond to a 3 grayscale gamma voltage representing a 3 grayscale, and the eighth gamma tab voltage VGT8 may correspond to a 203 grayscale gamma voltage representing a 203 grayscale.

In some embodiments, the gamma voltage generator 300B may further generate a compensating gamma tab voltage VGTC that is greater than the maximum gamma tab voltage VGT9, and may generate a compensating gamma maximum voltage V255' that is greater than the 255 grayscale gamma voltage V255, based on the compensating gamma tab voltage VGTC.

Either the maximum gamma tab voltage VGT9 or the compensating gamma tab voltage VGTC may be selected by the maximum gamma selector 370. The maximum gamma tab voltage VGT9 may be selected (or determined) as an output gamma tab voltage VGT9', and the 255 grayscale gamma voltage V255 may be output, when the target grayscale voltage is less than or equal to the maximum gamma tab voltage VGT9. The compensating gamma tab voltage VGTC may be selected (or determined) as the output gamma tab voltage VGT9', and the compensating gamma maximum voltage V255' may be output, when the target grayscale voltage is greater than the maximum gamma tab voltage VGT9.

As illustrated in FIG. 9, an additional curve based on the compensating gamma maximum voltage V255' may be added to the gamma curve corresponding to grayscales 0 to 255 without degradation. Thus, as described above, when the degradation occurs, the range of the gamma voltages output from the gamma voltage generator 300B may be expanded due to the simple hardware structure. Accordingly, the gamma curve of the display may be generated without a gamma resolution loss, even when the compensation of the degradation is performed. Further, as the range of the gamma voltages is expanded, a maximum luminance level that is capable of being displayed may be increased. For example, as illustrated in FIG. 9, the compensating gamma maximum voltage V255' may be added to the gamma voltages such that the maximum luminance level may be increased to 400 cd/$m^2$.

Figure 10:
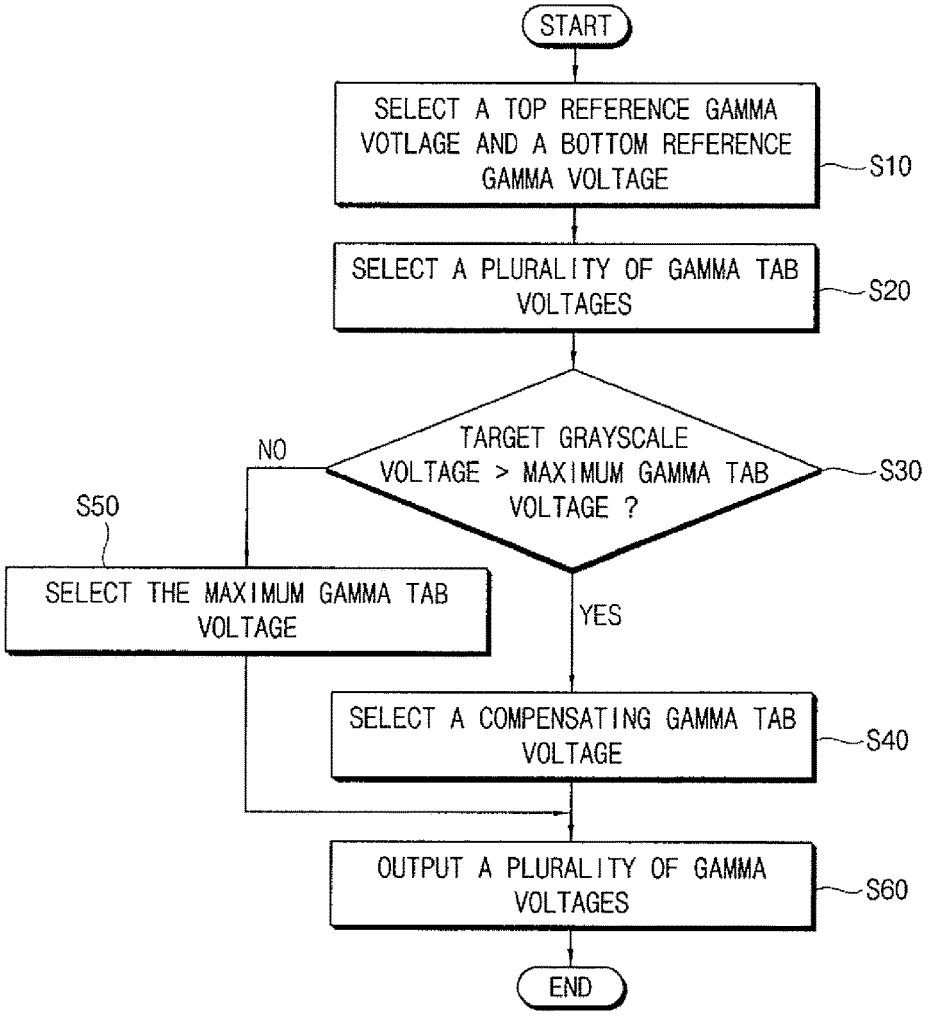
FIG. 10 is a flowchart of a method for generating gamma voltages according to example embodiments.

FIG. 10 is a flowchart of a method for generating gamma voltages according to example embodiments.

Referring to FIGS. 7 to 10, the method for generating the gamma voltages may include selecting a top reference gamma voltage corresponding to a maximum gamma tab voltage, and selecting a bottom reference gamma voltage corresponding to a minimum gamma tab voltage, based on a first reference voltage and based on a second reference voltage that is greater than the first reference voltage S10.

The method may further include selecting a plurality of gamma tab voltages within a range between the maximum gamma tab voltage and the minimum gamma tab voltage based on the top reference gamma voltage and based on the bottom reference gamma voltage S20.

The method may also include comparing a target grayscale voltage corresponding to compensated image data, in which degradation is compensated, with the maximum gamma tab voltage S30.

The maximum gamma tab voltage may be selected when the target grayscale voltage is less than or equal to the maximum gamma tab voltage S50. Alternatively, a compensating gamma tab voltage that is greater than the maximum gamma tab voltage may be selected when the target grayscale voltage is greater than the maximum gamma tab voltage S40.

The method may also include outputting a plurality of gamma voltages corresponding to a gamma curve based on the selected gamma tab voltages S60.

In some embodiments, the method for generating the gamma voltages of FIG. 10 may be performed by operations of the gamma voltage generator 300B of FIG. 7. Thus, duplicated descriptions that are described above referred to FIG. 7 will not be repeated.

The top reference gamma voltage and the bottom reference gamma voltage may be selected based on the first reference voltage and the second reference voltage S10. Here, the top reference gamma voltage and the bottom reference gamma voltage may be reference voltages for generating a plurality of gamma tab voltages within a range between the minimum gamma tab voltage and the maximum gamma tab voltage. The plurality of gamma tab voltages may be selected based on the top reference gamma voltage and the bottom reference gamma voltage S20.

The target grayscale voltage may be compared with the maximum gamma tab voltage S30. In some embodiments, a compensating enable signal for selecting one of the maximum gamma tab voltage and the compensating gamma tab voltage may be generated based on the comparison result.

The maximum gamma tab voltage may be selected when the target grayscale voltage is less than or equal to the maximum gamma tab voltage S50. In some embodiments, the plurality of gamma voltages corresponding to a gamma curve may be output by dividing voltages between the minimum gamma tab voltage and the maximum gamma tab voltage when the maximum gamma tab voltage is selected S60.

The compensating gamma tab voltage that is greater than the maximum gamma tab voltage may be selected when the target grayscale voltage is greater than the maximum gamma tab voltage S40. The compensating gamma tab voltage may be selected within a range between an externally supplied third reference voltage and the top reference gamma voltage. The third reference voltage may be greater than the second reference voltage and the top reference gamma voltage. In some embodiments, the plurality of gamma voltages corresponding to a gamma curve may be output by dividing voltages between the minimum gamma tab voltage and the compensating gamma tab voltage when the compensating gamma tab voltage is selected S60. An entire range of the gamma voltages may be expanded when the compensating gamma tab voltage is selected.

As described above, the method for generating the gamma voltages may additionally provide the compensating gamma tab voltage that is greater than the maximum gamma tab voltage according to a degree of degradation (or the compensation of the degradation), such that the range of the gamma voltages may be expanded. Accordingly, the gamma curve of the display may be generated without a gamma resolution loss, even if the compensation of the degradation is performed. In addition, as the range of the gamma voltages is expanded, a maximum luminance level capable of displaying may be increased.

The described embodiments of the present invention may be applied to any display device, and may be applied to any system including the display device. For example, the present embodiments may be applied to a television, a computer monitor, a laptop, a digital camera, a cellular phone, a smart phone, a smart pad, a personal digital assistant (FDA), a portable multimedia player (PMP), a MP3 player, a navigation system, a game console, a video phone, etc.

The foregoing is illustrative of example embodiments, and is not to be construed as limiting the present invention. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined by the claims and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims and their equivalents. The inventive concept is defined by the following claims, with equivalents of the claims to be included therein.

What is claimed is:

1. A gamma voltage generator, comprising:

a reference gamma selector configured to:

receive a first reference voltage;

receive a second reference voltage that is greater than the first reference voltage;

select a top reference gamma voltage corresponding to a maximum gamma tab voltage that is between the first reference voltage and the second reference voltage; and select a bottom reference gamma voltage corresponding to a minimum gamma tab voltage that is between the first reference voltage and the second reference voltage;

a gamma tab generator configured to select a plurality of gamma tab voltages that are between the maximum gamma tab voltage and the minimum gamma tab voltage based on the top reference gamma voltage and based on the bottom reference gamma voltage;

a maximum gamma compensator configured to select a compensating gamma tab voltage that is greater than the maximum gamma tab voltage based on the top reference gamma voltage and based on a third reference voltage that is greater than the second reference voltage; and a gamma output configured to:

divide the gamma tab voltages and the compensating gamma tab voltage; and output gamma voltages corresponding to a gamma curve, wherein the maximum gamma compensator comprises:

a compensating resistor string configured to divide voltages between the third reference voltage and the top reference gamma voltage; and a compensating gamma selector configured to select one of the voltages divided by the compensating resistor string as the compensating gamma tab voltage based on a compensating gamma select signal.

2. The gamma voltage generator of claim 1, wherein the maximum gamma compensator is further configured to select the compensating gamma tab voltage such that a range of the gamma voltages is expanded.

3. The gamma voltage generator of claim 2, wherein the range of the gamma voltages is from the minimum gamma tab voltage to the compensating gamma tab voltage.

4. The gamma voltage generator of claim 1, wherein the gamma curve is generated based on a range from the minimum gamma tab voltage to the compensating gamma tab voltage.

5. The gamma voltage generator of claim 1, further comprising a maximum gamma selector configured to:

select the maximum gamma tab voltage or the compensating gamma tab voltage as an output gamma tab voltage based on a compensating enable signal; and provide the output gamma tab voltage to the gamma output.

6. The gamma voltage generator of claim 5, wherein the maximum gamma selector is configured to select the maximum gamma tab voltage as the output gamma tab voltage when a target grayscale voltage, which corresponds to compensated image data for compensating degradation, is less than or equal to the maximum gamma tab voltage.

7. The gamma voltage generator of claim 5, wherein the maximum gamma selector is configured to select the compensating gamma tab voltage as the output gamma tab voltage when a target grayscale voltage, which corresponds to compensated image data for compensating degradation, is greater than the maximum gamma tab voltage.

8. The gamma voltage generator of claim 1, wherein the reference gamma selector comprises:

a reference resistor string configured to divide voltages between the first reference voltage and the second reference voltage;

a first reference selector configured to select one of the voltages divided by the reference resistor string as the bottom reference gamma voltage based on a bottom select signal; and a second reference selector configured to select one of the voltages divided by the reference resistor string as the top reference gamma voltage based on a top select signal.

9. The gamma voltage generator of claim 1, wherein the gamma tab generator comprises:

a plurality of resistor strings dependently connected to divide voltages between the top reference gamma voltage and the bottom reference gamma voltage; and a plurality of gamma tab selectors each configured to select one of the voltages divided by the plurality of resistor strings as one of the gamma tab voltages based on a plurality of gamma tab select signals.

10. The gamma voltage generator of claim 1, wherein the gamma output comprises a resistor string to divide voltages between the minimum gamma tab voltage and the compensating gamma tab voltage.

11. A display device, comprising:

a display panel comprising a plurality of pixels;

a scan driver configured to provide a scan signal to the pixels;

a gamma voltage generator configured to output a plurality of gamma voltages corresponding to compensated image data for compensating degradation;

a data driver configured to generate a data signal based on the gamma voltages, and configured to provide the data signal to the pixels; and a controller configured to generate the compensated image data, and configured to control the scan driver, the gamma voltage generator, and the data driver, wherein the gamma voltage generator comprises:

a reference gamma selector configured to:

receive a first reference voltage;

receive a second reference voltage that is greater than the first reference voltage;

select a top reference gamma voltage, which corresponds to a maximum gamma tab voltage, between the first reference voltage and the second reference voltage; and select a bottom reference gamma voltage, which corresponds to a minimum gamma tab voltage, between the first reference voltage and the second reference voltage;

a gamma tab generator configured to select a plurality of gamma tab voltages between the maximum gamma tab voltage and the minimum gamma tab voltage based on the top reference gamma voltage, and based on the bottom reference gamma voltage;

a maximum gamma compensator configured to select a compensating gamma tab voltage that is greater than the maximum gamma tab voltage based on the top reference gamma voltage, and based on a third reference voltage that is greater than the second reference voltage; and a gamma output configured to divide the gamma tab voltages and the compensating gamma tab voltage to output the gamma voltages corresponding to a gamma curve, and wherein the maximum gamma compensator comprises:

a compensating resistor string configured to divide voltages between the third reference voltage and the top reference gamma voltage; and a compensating gamma selector configured to select one of the voltages divided by the compensating resistor string as the compensating gamma tab voltage based on a compensating gamma select signal.

12. The display device of claim 11, wherein the maximum gamma compensator is further configured to select the compensating gamma tab voltage to expand a range of the gamma voltages.

13. The display device of claim 12, wherein the range of the gamma voltages is from the minimum gamma tab voltage to the compensating gamma tab voltage.

* * * * *